US008336615B2

(12) United States Patent
Hughes et al.

(10) Patent No.: US 8,336,615 B2
(45) Date of Patent: Dec. 25, 2012

(54) LOW PRESSURE-SET PACKER

(75) Inventors: John Hughes, Calgary (CA); John Wilson Thomas, Calgary (CA)

(73) Assignee: BJ Tool Services Ltd., Calgary (CA)

( * ) Notice: Subject to any disclaimer, the term of this patent is extended or adjusted under 35 U.S.C. 154(b) by 179 days.

(21) Appl. No.: 11/563,438

(22) Filed: Nov. 27, 2006

(65) Prior Publication Data

US 2008/0011471 A1 Jan. 17, 2008

(51) Int. Cl.
*E21B 33/12* (2006.01)

(52) U.S. Cl. ..... 166/120; 166/387; 166/179

(58) Field of Classification Search ..... 166/387, 166/378, 120, 185, 179
See application file for complete search history.

(56) References Cited

U.S. PATENT DOCUMENTS

| | | | | |
|---|---|---|---|---|
| 2,624,412 | A * | 1/1953 | Ragan | 166/120 |
| 2,836,250 | A * | 5/1958 | Brown | 166/134 |
| 3,160,209 | A * | 12/1964 | Bonner | 166/63 |
| 3,308,882 | A * | 3/1967 | Lebourg | 73/152.23 |
| 3,456,723 | A * | 7/1969 | Current et al. | 166/120 |
| 4,018,274 | A | 4/1977 | Cochran | |
| 4,044,826 | A | 8/1977 | Crowe | |
| 4,487,258 | A * | 12/1984 | Jackson et al. | 166/120 |
| 4,611,658 | A * | 9/1986 | Salerni et al. | 277/337 |
| 4,749,035 | A | 6/1988 | Cassity | |
| 5,070,941 | A * | 12/1991 | Kilgore | 166/98 |
| 5,343,949 | A * | 9/1994 | Ross et al. | 166/278 |
| 5,511,617 | A * | 4/1996 | Snider et al. | 166/291 |
| 5,810,082 | A * | 9/1998 | Jordan, Jr. | 166/120 |
| 6,283,211 | B1 * | 9/2001 | Vloedman | 166/277 |
| 6,296,052 | B1 | 10/2001 | Sidwell | |
| 6,564,876 | B2 * | 5/2003 | Vaynshteyn et al. | 166/387 |
| 6,739,398 | B1 | 5/2004 | Yokley et al. | |
| 2006/0102361 | A1 * | 5/2006 | Fay et al. | 166/387 |

FOREIGN PATENT DOCUMENTS

| | | |
|---|---|---|
| CA | 2212590 | 2/1998 |
| CA | 2228494 | 1/2008 |

OTHER PUBLICATIONS

Innicor Completion Systems, Operation Procedure, Running Setting Retrieving and Part List, Jan. 2006, p. 1, Unit No. 649-1046-0000, Canada.

* cited by examiner

*Primary Examiner* — Jennifer H Gay
*Assistant Examiner* — Elizabeth Gitlin
(74) *Attorney, Agent, or Firm* — Bennett Jones LLP

(57) ABSTRACT

A packer tool for use in a wellbore having a bottomhole pressure p, includes: a mandrel assembly; a stabilizer on the mandrel assembly, for releasably engaging the wellbore; a packing element in an annular recess having a floor and two facing walls, the annular recess being transversely compressible into a compressed position and disposed about the mandrel assembly; and a piston assembly for driving compression of the packing element annular recess. The piston assembly has a plurality of piston faces moveable together in the same direction, the plurality of piston faces having a total piston face surface area a such that an application of pressure of p' to the piston assembly generates a force f greater than p.

3 Claims, 4 Drawing Sheets

LOW PRESSURE-SET PACKER

FIELD OF THE INVENTION

The field of this invention relates to packers set in wellbores of hydrocarbon-producing formations by applied pressure, and methods for using same.

BACKGROUND OF THE INVENTION

For wells in low-pressure formations that do not require the use of steel tubing, corrosion issues that may arise can be avoided by instead employing plastic tubing. In running in tubing using applied pressure, the bottomhole pressure (typically about 800 psi in such low-pressure wells) must still be overcome in order to set packers, and conventional tools can generate just enough force with the application of the equivalent of the bottomhole pressure to set the packers. As packers are typically set inside casings, the force of setting such a tool may be transferred through the tool into the casing. However, the pressure required to generate the setting force is transferred to the well formation through perforations in the casing wall whenever the pump-out plug below the packer is shifted and opens communication between the tubing string and well below the packer, which can result in damage. Also, the pressure can act to cause failures in the connections of the tubing string. Although such failures may in some cases be avoided by strengthening the connections, this may further complicate the normal handling of the plastic tubing. So, since even as little as 800 psi can damage well formations and plastic tubing, there is a need for an improved packer tool that requires the application of less pressure and thus is less likely to cause damage.

SUMMARY

In one aspect of the invention, there is provided a packer tool for use in a wellbore having a bottomhole pressure p, the tool comprising: mandrel assembly; a stabilizer on the mandrel assembly, for releasably engaging the wellbore; a packing element in an annular recess having a floor and two facing walls, the annular recess being transversely compressible into a compressed position and disposed about the mandrel assembly; and a piston assembly for driving compression of the packing element annular recess, the piston assembly having a plurality of pistons connected to act in tandem, the pistons having a total piston face surface area a such that an application of pressure of p' to the piston assembly generates a force f greater than p.

In another aspect of the invention, the packer tool may further include a quantity of sealing element disposed in the annular recess and being resiliently deformable into sealing engagement with the wellbore.

In yet another aspect of the invention, the packer tool may be set in response to the application of pressure less than 800 psi.

In accordance with another aspect of the present invention, there is provided downhole assembly comprising: a plastic tubing string including an inner diameter; and a packer connected to the plastic tubing string and in fluid communication with the inner diameter of the plastic tubing string, the packer including: a mandrel assembly; a stabilizer on the mandrel assembly, for releasably engaging the wellbore; a packing element in an annular recess having a floor and two facing walls, the annular recess being transversely compressible into a compressed position and disposed about the mandrel assembly; and a piston assembly for driving compression of the packing element annular recess, the piston assembly having a plurality of pistons connected to act in tandem, the pistons capable of driving compression of the packing element annular recess at applied pressures of less than 800 psi.

In accordance with another broad aspect, there is provided a method for setting a production string in a wellbore, the method comprising: running into a wellbore a plastic tubing string with an expandable packer installed thereon, the expandable packer including a mandrel assembly; a stabilizer on the mandrel assembly, for releasably engaging the wellbore; a packing element in an annular recess having a floor and two facing walls, the annular recess being compressible into a compressed position and disposed about the mandrel assembly; and a piston assembly for driving compression of the packing element annular recess, the piston assembly having a plurality of pistons connected to act in tandem, the expandable packer being in fluid communication with surface through an inner diameter of the plastic tubing string; setting the stabilizer to engage the wellbore; and applying pressure of less than 800 psi to drive the piston assembly to drive compression of the packing element annular recess to pack off about the packer.

It is to be understood that other aspects of the present invention will become readily apparent to those skilled in the art from the following detailed description, wherein various embodiments of the invention are shown and described by way of illustration. As will be realized, the invention is useful for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF VARIOUS EMBODIMENTS

Figure 1A:
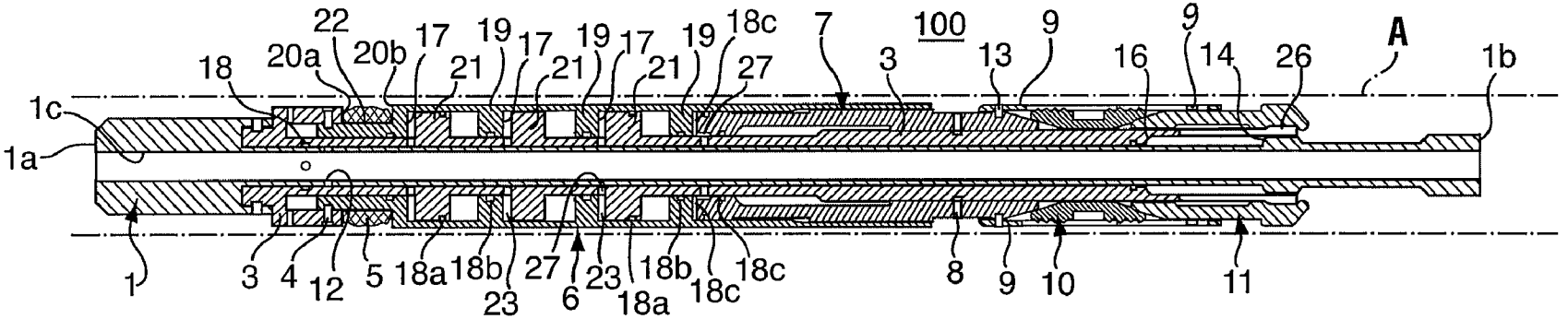
FIG. 1A to FIG. 1F are longitudinal sections of a packer tool in accordance with an embodiment of the invention.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

In the following description of the invention, it is to be understood that although the reference is made to a borehole wall, it is to be understood that the borehole could be open hole or lined. For example, without limitation, the invention may be used in an open hole or in wellbore liners such as casing.

Tools of the invention may generate sufficient force to overcome bottomhole hydrostatic pressure and set packer elements by decreasing the quantum of applied pressure while increasing the piston surface area by which such pressure is applied. Given bottomhole conditions, pistons in tools of the invention may be placed above or below the packer element, and piston and piston abutment surface area may be increased either by simply increasing the size of these components, or, where the diameter of the borehole is a limiting factor, by increasing the number of pistons to thereby increase the piston face area.

As shown in FIG. 1, in an embodiment of the invention, the packer tool 100 may include an inner mandrel 1 including an upper end 1*a* and a lower end 1*b*. Although not shown, upper and lower ends 1*a*, 1*b* of the inner mandrel are formed for connection to a tubing string. A bore 1*c* of the inner mandrel is in fluid communication with the inner bore of tubing string thereabove. Bore 1*c* either includes a plug to seal against fluid flow out through lower end or a plug is positioned in a tubing string connected below the packer, as in the illustrated embodiment, such that fluid pressure can be applied to actuate the packer.

Positioned about inner mandrel 1, in slidable engagement therewith, is an outer mandrel 3. Positioned about outer mandrel 3 is a piston housing 6 in slidable engagement with the lateral surface of outer mandrel 3.

The tool may include a stabilizer for stabilizing the tool against the borehole wall A, such as, without limitation, an anchor assembly or a slip and cone assembly. In the embodiment shown in FIG. 1, the stabilizer includes upper cone element 7, lower cone element 11, slips 10, and slip retaining elements 9. In such embodiments, one or both of the upper and lower cone elements may slidably approach one another to push the slips out into anchoring engagement with the borehole, and in some of these embodiments, may slide away from each other in order to allow the slips to fall back in and disengage from the borehole. In the illustrated embodiment, upper cone element 7 may include an end 7*a* forming a piston face such that the cone can be driven by fluid pressure toward lower cone element 11 to set the stabilizer. Upper cone element 7 may be positioned coaxially in slidable relation between outer mandrel 3 and piston housing 6.

Since the wellbore has a bottomhole pressure p inhibiting the insertion and setting of the packer, in order to set the packer an opposing force f is applied to the tool to overcome the bottomhole pressure; typically, opposing force f of about 5000 lbs is required to do so. In the piston assembly of the present invention, the force applied to the tool is transmitted by the one or more pistons to compress the packer seal, the operative piston face surface area being selected to exceed f/p. Given that the dimensions of the wellbore may present some limitations on the diameter of the tool and therefore the operative surface area of the piston, a plurality of pistons may be connected to act in tandem in order to provide a total operative surface area a that exceeds f/p. Thus, where conventional tools may generate just enough force at 800 psi to set in low pressure wells, in the present invention the required pressure can be reduced by increasing the operative piston surface area; for example, if the surface area is increased by three times (as compared to conventional packers requiring 800 psi to set), then sufficient force would be generated at somewhat less than 300 psi (that is, upon the application of a pressure p' that exceeds f/a). In one embodiment of a tool according to the present invention, the tool has a 3.8 inch diameter and the total operative piston area may be greater than 6.25 square inches and in one embodiment greater than about 15 square inches divided over a plurality of, for example, four pistons acting in tandem.

In the particular embodiment illustrated in FIG. 1, piston assembly 6 includes pistons 19, each with a piston face 17, all connected to piston assembly. Outer mandrel 3 may be formed or assembled to provide piston abutments 21 to cooperate with pistons 19 to form piston chambers 23. While in some embodiments the pistons and/or the piston abutments may be annular, it is not necessary that these elements take such a configuration and in other embodiments non-annular pistons and/or abutments may be provided. Further, the embodiment in this figure includes a plurality of pistons and cooperating abutments, but it is to be understood that a single piston/abutment pair may be provided in accordance with the invention.

Tool 100 of the embodiment in FIG. 1 further includes annular recess 22 that may be narrowed for the purpose of compressing a quantity of sealing element 5 so that it forms a pack-off seal between the tool 100 and the borehole wall. In some embodiments, the annular recess may be widened from the narrowed (that is, compressed) position in order to allow the sealing element to relax and thereby disengage from the borehole wall. In embodiments compression of the annular recess is facilitated by at least one of two side walls of the annular recess being slidable toward each other. In the embodiment shown in FIG. 1, the outer mandrel 3 forms a first annular recess wall 20*a* while the piston housing 6 forms the other annular recess wall 20*b*. Annular recess wall 20*b* is moveable toward and away from wall 20*a* by action of the piston housing. While FIG. 1 illustrates an embodiment in which the packer sealing element 5 is disposed above the piston assembly, it is to be understood that in some embodiments the piston assembly may be disposed above the annular recess. In embodiments having the piston assembly disposed between the annular recess and the stabilizer assembly and seals (such as o-rings) for the engagement of the various sliding parts, the placement the piston assembly below the packer sealing element 5 prevents leakage past the tool if at some point after the tool is set any of the seals fail, since all such leakage would be located below the primary seal of the annular sealing element to the wellbore wall.

The characteristics of the elastomer comprising the sealing element and its geometry are relevant to the operation of tool; the composition of elastomer should be selected to withstand the temperature, depth, and other conditions of the wellbore location at which the tool is to be set. As well, on one hand, the quantity (that is, volume) of sealing element must be enough to permit it to withstand a selected differential pressure across the sealing element; a differential pressure of 5,000 psi is often the upper limit of what tools in most wells encounter, even though some tools are expected to only accommodate lower differential pressures, such as around 800 psi. On the other hand, in accordance with this invention the sealing element may be completely packed off with as low a force as possible to avoid damaging the tubing or the well. Too great a quantity of sealing element 5 will require a greater pack-off force, while not enough will reduce the sealing element's ability to withstand differential pressure and thus affect the tool's integrity. Elastomer selection and geometry for given well and component conditions would be understood by those skilled in the art.

Figure 2:
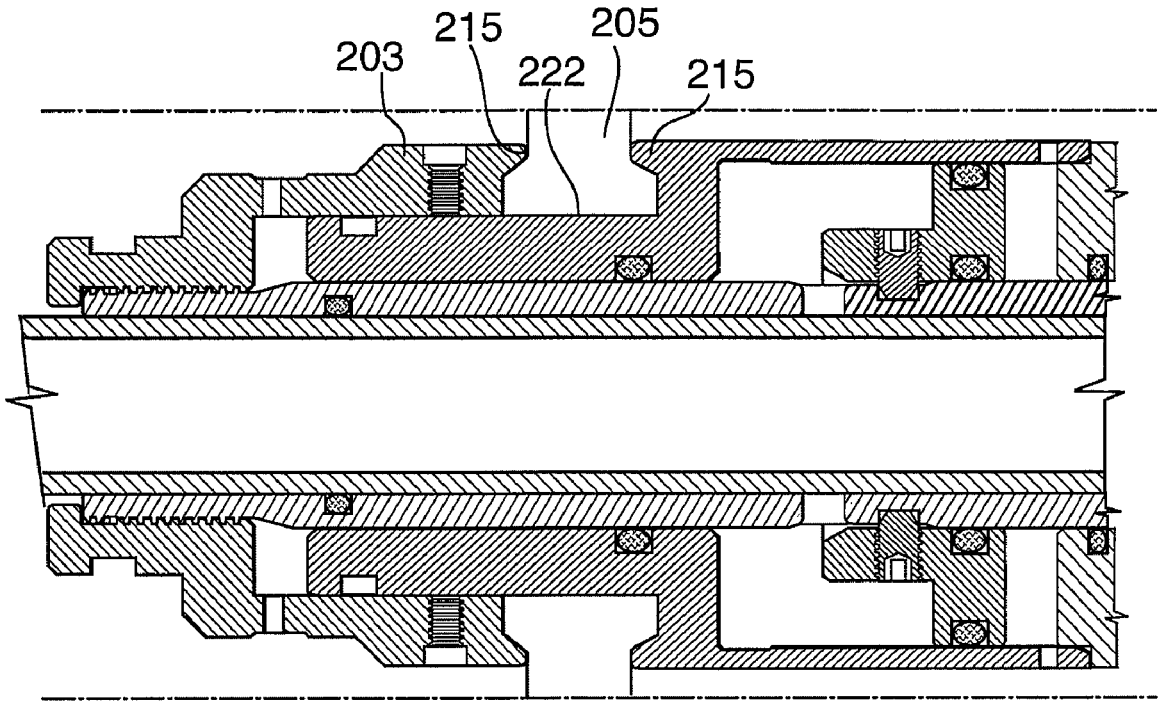
FIG. 2 is a sectional detail of an annular recess of a packer tool in accordance with an embodiment of the invention.

The geometry of the annular recess on both sides of the sealing element may also be selected to assist in sealing the sealing element against the mandrel assembly; for example, in the embodiment shown in FIG. 2, gauge rings 215 may be provided on either side of annular recess 222 and configured to trap sealing element 205 and generate a force against it that helps provide a seal between sealing element 205 and mandrel 203.

Shear elements (such as pins, screws, etc.) may also be provided in some embodiments of the present invention, to ensure that movement of particular components is inhibited until desired, for example to act against accidental setting and/or to control the sequential movement of parts. For example, in the embodiment of FIG. 1, tool 100 is provided with packer-setting shear elements 4 and slip-setting shear elements 8 and 13 each having specific shear values. Slip-setting shear elements 8, 13 prevent movement of lower cone element 7 and slip retainers 9, respectively, and therefore engagement of slips 10 with the borehole, and packer-setting shear elements 4 prevent movement of piston housing 6, and therefore compression of sealing element 5, at least until the shearing force exceeds the specific shear values of these shear elements. The specific shear value of shear elements will bear upon the pressure under which you wish a particular part to move. For example, if it is desired to set the sealing element at 200 psi, elastomers that can be set at that pressure are selected and shear elements having a shear value less than 200 psi (for example, 150 psi) to prevent premature shearing are selected. (However, although shear elements having shear values as low as about 50 psi are available, such shear elements would not be necessary if the selected elastomers settable at such low pressures cannot withstand the differential pressure conditions of the well.) Where a higher setting pressure is desired, shear elements that can withstand higher shear values may be selected, and/or more shear elements can be provided.

Figure 1B:
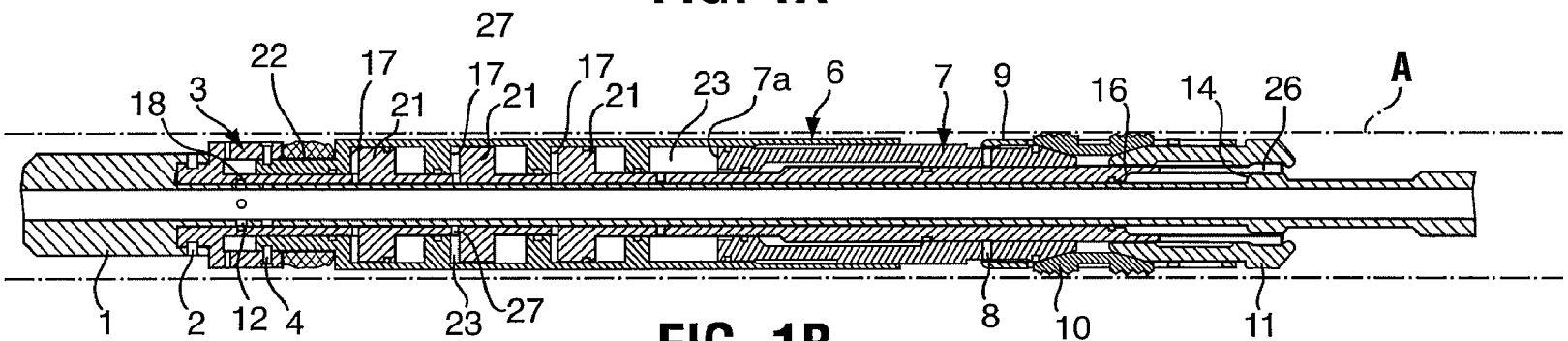

Referring to FIGS. 1A and 1B, in operation the packer tool 100, including the tubing string with packer, is first run to setting depth. Once at setting depth, pressure applied to tool 100 (such as by a pump at surface) communicates through setting port 12 (located on inner mandrel 1), passes along a microannulus between inner mandrel 1 and outer mandrel 3 and through ports 27 to be conveyed to pistons 7*a* and 19 to drive operation of the tool. Various seals such as seals 18, 18*a*, 18*b*, contain and direct the fluid pressure through the packer. As fluid pressure builds in chambers 23, shear elements 8 holding upper cone element 7 are selected to fail first. The shear value of shear elements 8 is pre-selected to be greater than that pressure required to locate the tubing string 100 at the desired position in the borehole. For those circumstances in which sudden stops in running the tubing string into the well (which may result in the linear momentum of the cone elements causing them to "sling shot" into the slips) or vibration are a risk, it may be desirable to select a minimum shear value that is higher than the force that would be applied on the shear elements by such vibration or sudden stops in order to avoid premature setting. Once the cone shear elements 8 shear, the tubing pressure then drives the upper cone 7 longitudinally towards lower cone 11 of cone assembly 15, thereby pushing slips 10 to ride up cone assemblies 7 and 11 and radially outwards toward the casing wall. Such motion causes slips 10 to exert pressure on slip cages 9 to move out of the slip path, causing the shearing of slip-setting shear elements 13 and the longitudinal movement of slip cages 9 away from slips 10. Once slips 10 are no longer restrained by slip cages 9, continued longitudinal compression of cone assembly 15 causes slips 10 to continue to ride up the upper and lower cones 7 and 11 until slips 10 engage the casing wall A and thus stabilize the position of the packer and the tubing string within the borehole. While in the embodiment shown in FIG. 1 the cone shear elements 8 are disposed in the upper cone assembly 7, it is to be understood that they may be disposed in any component of the device that may be used to prevent the slips from being prematurely displaced. In other embodiments, a mechanical anchor or other stabilizing element may be used instead of a slip and cone assembly.

Figure 1C:
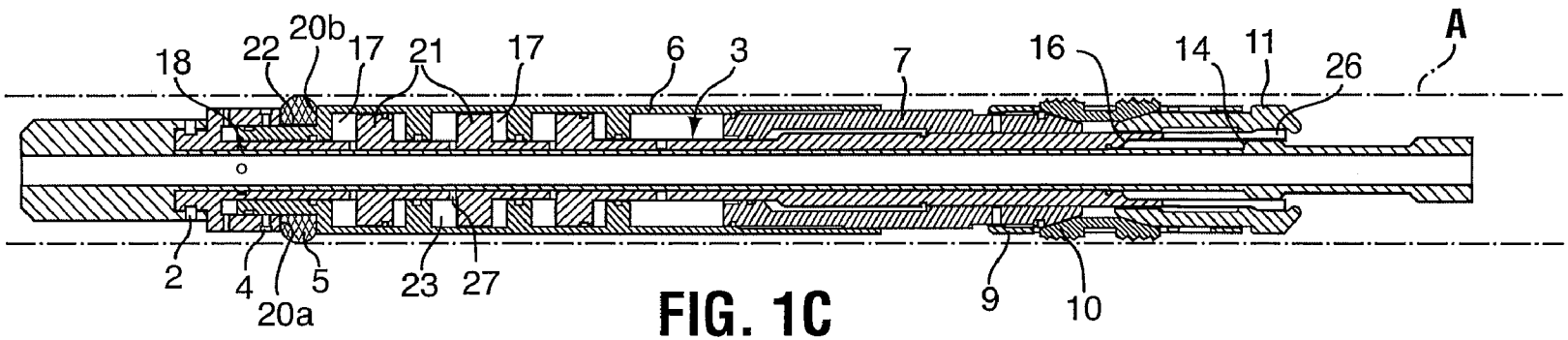
Figure 1D:
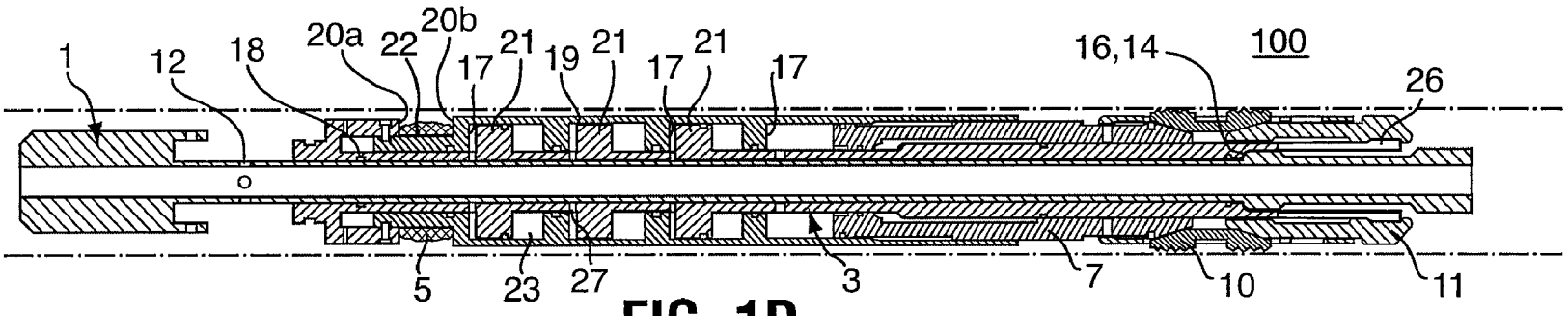
Figure 3:
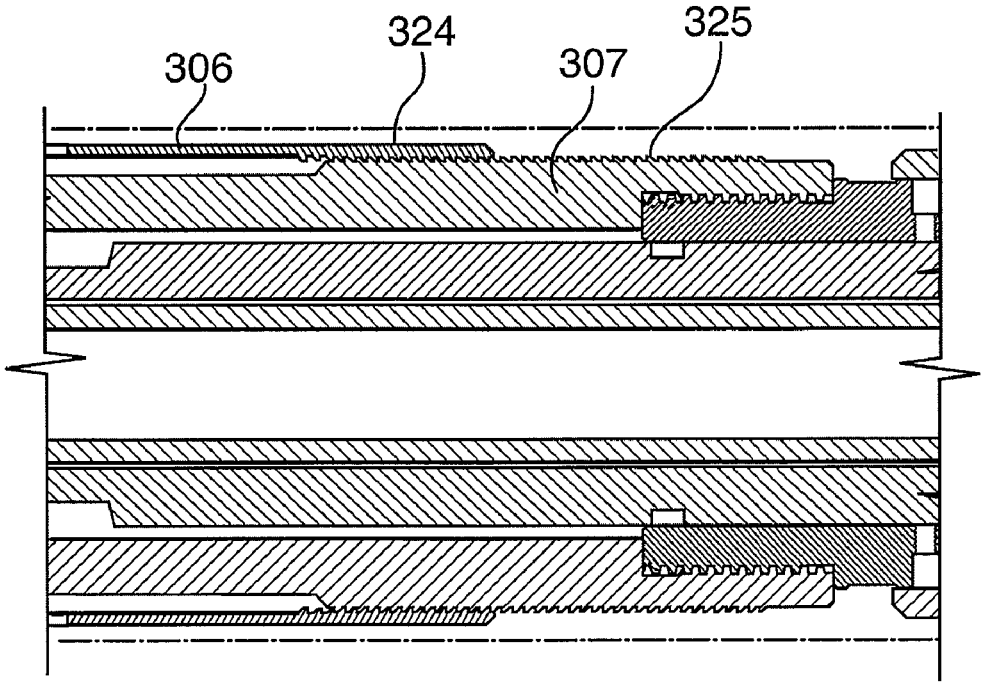
FIG. 3 is a sectional detail of a ratchet locking system of a packer tool in according with an embodiment of the invention.

Referring to FIG. 1C, once slips 10 set, tubing pressure can be further increased to shear the packer-setting shear elements 4. In embodiments having slip-setting and packer-setting shear elements, the shear value of the packer-setting shear elements may be higher than that of the slip-setting shear elements so that the stabilizer is operated to hold the packer in position in the wellbore before the packer is set. Once shear elements 4 shear, fluid pressure against piston faces 17 and reacted against abutments 21 cause piston housing 6 to slide along the outer mandrel thereby generating the setting force. The piston housing 6 travels up and wall 20*b* compresses sealing element 5 to pack it off. In some embodiments, a locking system may be provided to ensure force is always trapped in the tool to prevent the piston housing 6 from sliding back to unset the packer. Referring to FIG. 3, for example, a ratchet system may be used, including ratchet fingers 324 extending from piston assembly 306 that operatively engage ratchet thread 325 along the outer surface of upper cone assembly 307. While such a locking system may not necessarily stop further setting motion (and indeed in some circumstances it may be desirable to allow the tool to pack off more whenever it is exposed to a pressure differential greater than the setting pressure), it can be used to ensure that force is always in the tool to inhibit release of the tool.

In the embodiment, illustrated in FIG. 1, the tool can be unset, if desired, for retrieval to surface. Referring to FIG. 1D, to remove the tool 100 from the borehole, with the packer set in the borehole, a pulling force is applied upwardly to the inner mandrel 1. At a predetermined shear value brass shear screws 2 between the inner mandrel and outer mandrel 3 will be sheared, allowing inner mandrel assembly 1 to move upward within outer mandrel 3 until shoulder 14 of inner mandrel assembly 1 contacts and stops against complementary shoulder 16 of outer mandrel assembly 3. After tool 100 has been released by pulling inner mandrel 1 into tension, the setting ports 12 on the inner mandrel assembly 1 shift past the O-ring 18 and are thus exposed to the annulus above the packing element 5. Differential pressure in the well from above and below can then equalize across the tool 100 through the setting ports 12.

Figure 1E:
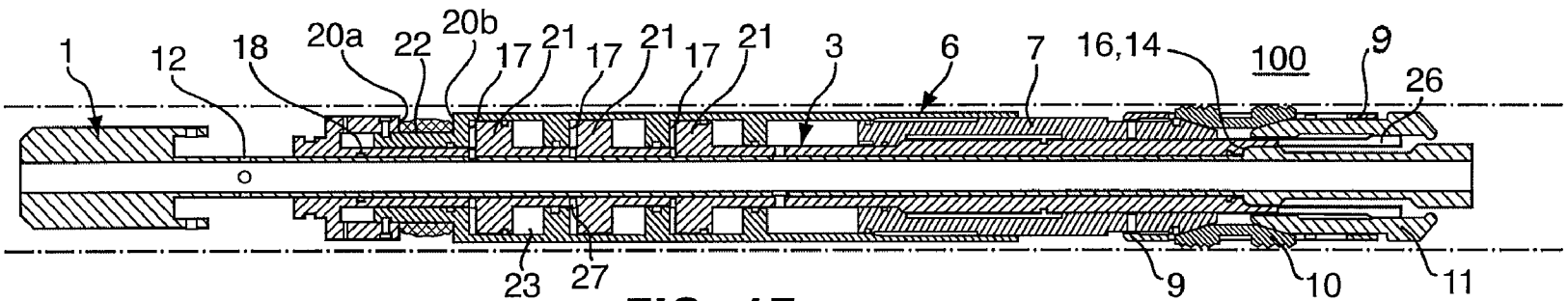
Figure 1F:
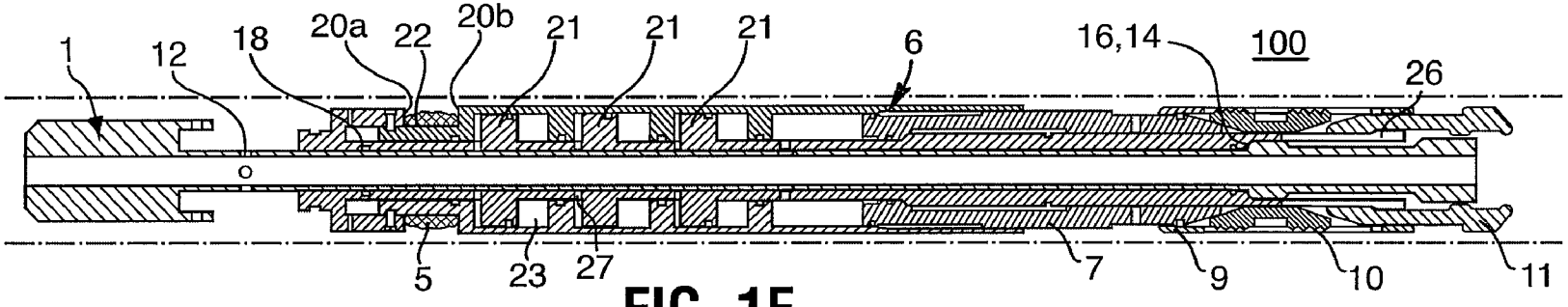

Referring to FIGS. 1E and 1F, with the engagement of shoulders 14 and 16, the inner mandrel assembly 1 picks up the outer mandrel assembly 3 and moves it upward. The upward movement of the outer mandrel assembly 3 pulls wall 20*a* away from wall 20*b*, allowing sealing element 5 to relax and unset.

Movement of inner mandrel 1 relative to outer mandrel also positions a small diameter section on the inner mandrel assembly 1 below collet fingers 26 on the outer mandrel assembly 3, thus allowing the collet fingers to collapse and be pulled axially to engage in a groove on the inner side of the lower cone 11, and as the outer mandrel assembly 3 continues to move back up, it picks up the piston assembly 6 and upper cone assembly 7 to pull it from under slips 10. Then the upper cone assembly 7 picks up the slip cage 9 to release the lower side of the slips 10, such that the tool 100 is fully released and can be pulled out from the well. In this fashion, the tubing can then be serviced and the packer can be repaired for and refit with shear elements for reuse.

Figure 4:
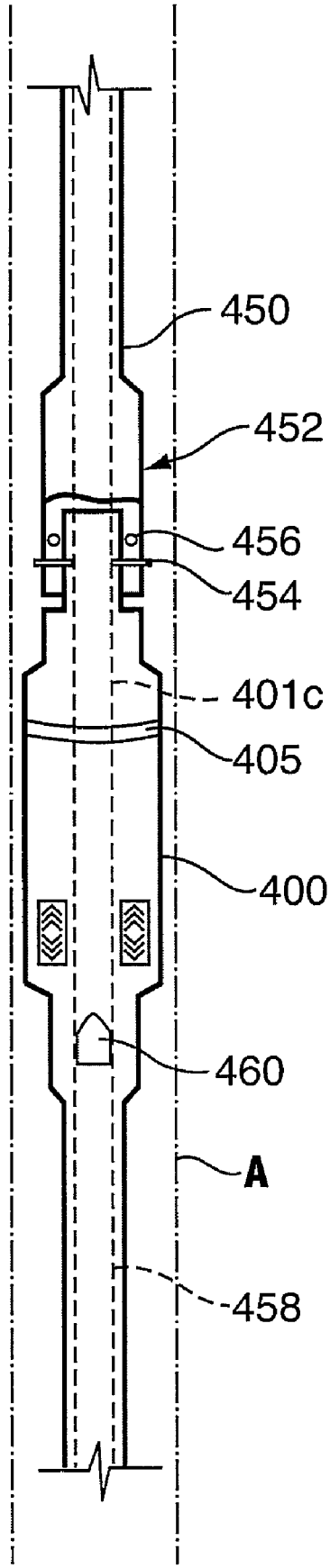
FIG. 4 is a schematic elevation of a packer tool and tubing system according to the present invention.

With reference to FIG. 4, a packer 400 including multiple pistons connected to act in tandem to drive a piston housing against an expandable packer element 405 such as for example with reference to those of FIGS. 1 to 3, may provide a packer capable of packing off at pressures lower than 800 psi, for example, between about 150 and 800 psi and possibly about 300 psi. Such a packer may be useful in assemblies including a plastic tubing string 450 from surface, such as in some production strings. Such assemblies may include connections 452 that are susceptible to failure or damage at pressures normally used for setting hydraulically set packers. While previously it may be believed that such connections 452 would have to be strengthened in order to employed a hydraulically set packer therewith, use of a packer according to the present invention may avoid such detrimental effect to connections without the need to strengthen them. One such connection 452 may include for example a tension release mechanism, including shear screws 454 and seals 456, of a grapple sub.

An assembly using plastic tubing string 450 and packer 400 may include a plastic tubing string segment 458 connected below the packer and which may include a plug 460 for holding pressure in the packer bore 401*c* for actuation thereof. Plug 460 may include a blow out mechanism for removal of the plug, if desired.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A method for setting a production string in a wellbore, the method comprising: running into a wellbore a plastic tubing string with an expandable packer installed thereon, the expandable packer including a mandrel assembly; a stabilizer on the mandrel assembly, for releasably engaging the wellbore; a piston to drive the stabilizer to engage the wellbore, the piston being driveable when a first fluid pressure is applied to the piston; a packing element in an annular recess having a floor and two facing walls, the annular recess being compressible into a compressed position and disposed about the mandrel assembly; a piston assembly for driving compression of the packing element annular recess, the piston assembly having a plurality of piston faces moveable together in the same direction and exposed for fluid contact in a pressure chamber; and a releasable lock to prevent movement of the piston assembly until a fluid pressure greater than the first fluid pressure is applied against the plurality of piston faces, the expandable packer being in fluid communication with surface through an inner diameter of the plastic tubing string; setting the stabilizer to engage the wellbore by applying the first fluid pressure, of less than 800 psi, through the plastic tubing to move the piston; after setting the stabilizer, applying a pressure of less than 800 psi and greater than the first fluid pressure through the plastic tubing and into the pressure chamber directly into contact with the plurality of piston faces to drive the piston assembly to drive compression of the packing element annular recess to pack off about the packer; and applying a pulling force to the mandrel assembly to release compression of the packing element annular recess.

2. The method according to claim 1 further comprising opening a plug below the piston assembly of the packer to permit production through the packer and plastic tubing string.

3. The method according to claim 1 further comprising applying tension to the plastic tubing string to shear the plastic tubing string from the packer.

* * * * *